United States Patent [19]

Meylan

[11] 3,942,907

[45] Mar. 9, 1976

[54] TWO-SHELL CASING FOR FLUID FLOW MACHINE

[75] Inventor: Pierre Meylan, Neuenhof, Switzerland

[73] Assignee: BBC Brown Boveri & Company Limited, Baden, Switzerland

[22] Filed: Jan. 31, 1975

[21] Appl. No.: 546,119

[30] Foreign Application Priority Data

Apr. 2, 1974 Switzerland ..... 4570/74

[52] U.S. Cl. ..... 415/126; 415/219 R

[51] Int. Cl.[2] ..... F04D 29/40

[58] Field of Search..... 415/126, 108, 201, 219 R, 415/199 R

[56] References Cited

UNITED STATES PATENTS

| | | | |
|---|---|---|---|
| 976,260 | 11/1910 | Hicks | 415/201 |
| 1,322,221 | 11/1919 | Baumann | 415/219 R |
| 1,322,222 | 11/1919 | Baumann | 415/219 R |
| 2,199,595 | 5/1940 | Millard | 415/201 |
| 2,428,999 | 10/1947 | Smith et al. | 415/201 |
| 2,929,218 | 3/1960 | Yates | 415/126 |
| 3,628,884 | 12/1971 | Mierley | 415/199 R |
| 3,881,843 | 5/1975 | Meylan | 415/219 R |
| 3,892,500 | 7/1975 | Miller et al. | 415/219 R |

*Primary Examiner*—Henry F. Raduazo
*Attorney, Agent, or Firm*—Pierce, Scheffler & Parker

[57] ABSTRACT

A fluid-flow machine such as a steam turbine including an inner shell surrounding the rotor component of the machine and which is secured to the foundation, and an outer shell surrounding the inner shell and which is composed of three principal components, these being a support frame secured to the foundation, an exhaust duct for the steam or other motive fluid depending from the frame and leading to the condenser, and an exhaust cover above the frame. The inner shell is divided along a horizontal plane passing through the rotor axis into upper and lower hemi-cylinder halves. Each end of the frame includes a lower fixed part incorporating the lower half of the pass-through structure for the rotor shaft and a removable upper part in the form of a yoke beam incorporating the upper half of the shaft pass-through structure. The exhaust cover is divided into two longitudinally extending separable halves joined to each other and to the adjacent surfaces of the support frame by means of fluid-tight connection flanges, so that by disconnecting the flanges and removing the two halves of the exhaust cover, and disconnecting and removing the upper hemi-cylindrical half of the inner shell, and disconnecting and removing the yoke beams at each end of the support frame, the rotor is completely exposed and can be lifted upwardly and removed after the shaft bearings are opened.

6 Claims, 5 Drawing Figures

FIG. 1
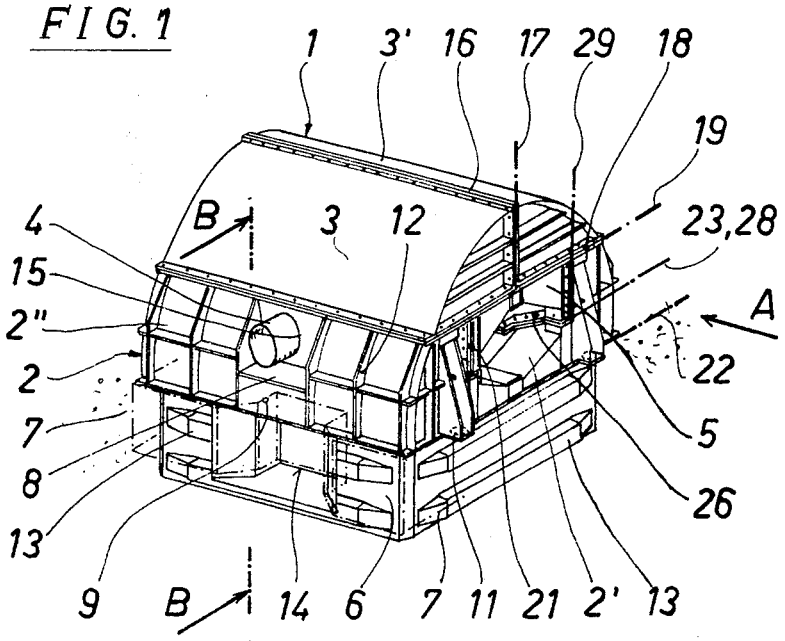
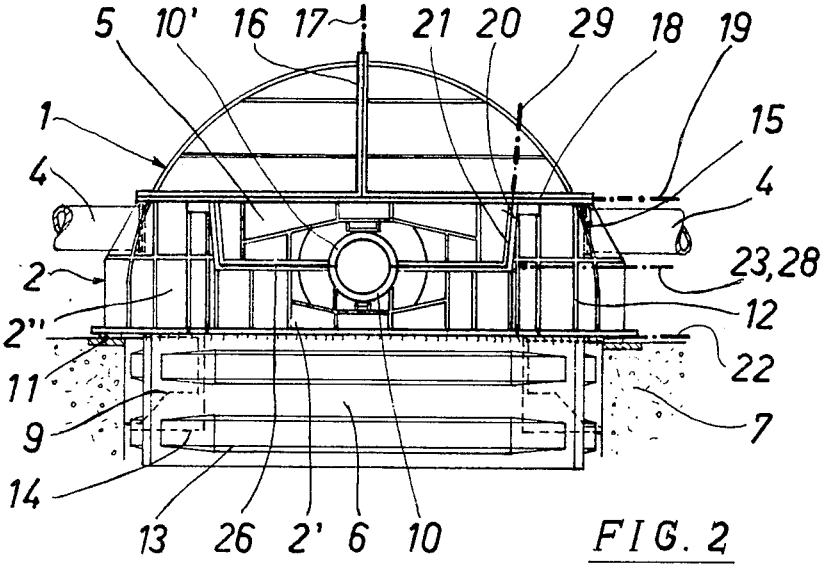
FIG. 2

FIG. 5
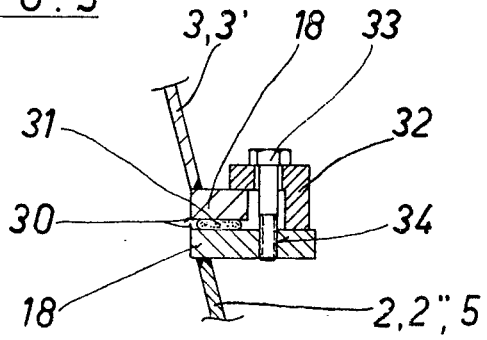
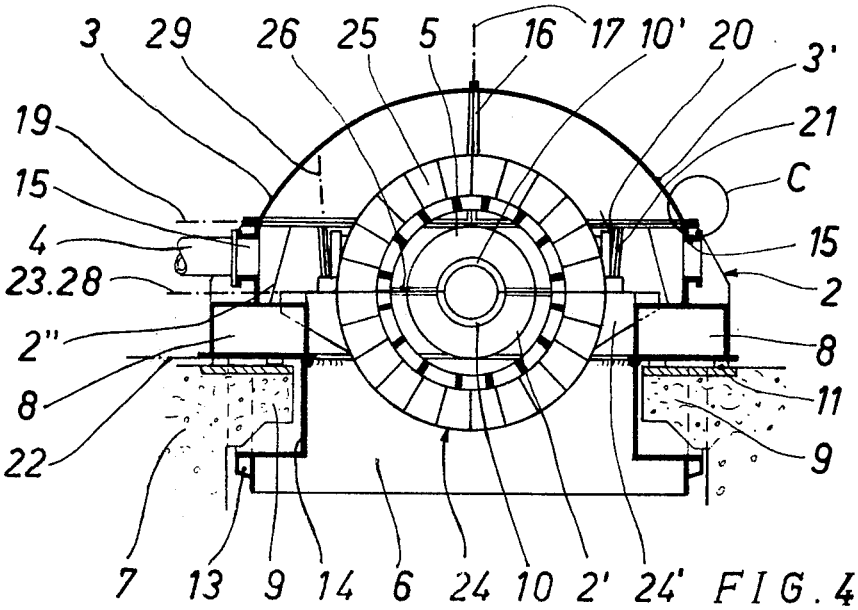
FIG. 4

TWO-SHELL CASING FOR FLUID FLOW MACHINE

The present invention concerns an improved construction for a casing for a fluid-flow machine of two-shell construction, its inner shell being split in the axial horizontal plane and its outer shell comprising essentially the exhaust cover, exhaust duct and a closed supporting frame, these being joined in horizontal and approximately vertical dividing planes, the supporting frame being rigidly fixed to the foundation of the machine in the region of the bearing points of the inner shell.

Owing to the rapid rise in the unit capacities of turbosets, space requirements have become an increasingly serious problem for power plant operators. On the one hand, during the erection of turbosets, the overall length of which often exceeds 70 m, large parking areas are needed for the separate components of the installation, and on the other, these extensive parking areas by the machines must be kept clear even after installation of the power station plant is complete. This is so that the large casing sections can be set aside within the power station building when the machines are being overhauled.

With the methods customary today, whereby the individual parts are assembled on the power station site, this need is all the greater because the parts delivered during erection and which then have to be assembled are for the most part welded together, and repeated separation of these joints is not possible. It is therefore necessary to provide sufficient space within the power station to allow the casing sections to be placed on the side during overhauls. The quantity of parking space needed in the building is particularly extensive in the case of the large low-pressure casings of steam turbines.

The object of the invention is to create a casing for a fluid flow machine whereby the parking area to be provided in the power station building can be reduced to a minimum.

This object is achieved in that the dividing planes between exhaust cover, exhaust duct and supporting frame are parallel and respectively above and below the axial horizontal dividing plane of the inner shell, a yoke beam for the upper half of the shaft pass-through part being attached by means of removable fixings to the supporting frame in the region of the shaft pass-through, and the exhaust cover is divided into separable halves which are joined by way of a gastight flange both to each other and also to the supporting frame and the yoke beam.

More particularly, in accordance with the invention the inner shell surrounding the rotor component of the turbomachine is divided along a horizontal plane passing through the rotor axis into upper and lower separable hemi-cylindrical halves and secured to the foundation. The outer shell which surrounds that inner shell is comprised of a support frame secured to the foundation, an exhaust duct for the steam or other motive fluid depending from the frame and an exhaust cover above the support frame. Each end of the frame includes a lower fixed part incorporating the lower half of a pass-through structure for the rotor shaft and a removable upper part in the form of a yoke beam incorporating the upper half of the shaft pass-through structures. The exhaust cover is divided into two longitudinally extending separable halves joined to each other and to the adjacent surfaces of the support frame by means of fluid-tight connection means, so that by disconnecting and removing the two halves of the exhaust cover, and disconnecting and removing the upper hemi-cylindrical half of the inner shell, and disconnecting and removing the yoke beams at each end of the support frame, the rotor is completely exposed and can be lifted upwardly and removed.

Thus, when the turbine is being overhauled, this not only allows the halves of the exhaust cover to be separated and parked simply on the supporting frame, for example, but also has the advantage that the upper part of the inner shell can be lifted without additional assistance. At the same time, the glands, and hence also the yoke beam and the rotor bearings, can remain unopened so that the set clearances are not disturbed.

Furthermore, fabrication of the casing is simplified. On the one hand, the precision machining of the flange surfaces on the supporting frame can be largely eliminated, since only the yoke beam has to be fitted in the frame, and on the other, the flange for joining the exhaust cover halves to the supporting frame can be machined before the plates are welded, without any need for subsequent machining. This is made possible by using flexible sealing material, e.g. soft rubber section, between the sealing surfaces of the flange between exhaust cover and supporting frame.

A particular advantage is the free choice of configuration for the supporting frame, as no account need be taken of the otherwise customary dividing plane in the axial horizontal plane. The incoming ducts carrying the working medium can thus be passed through the supporting frame to the inner shell, without having to be removed when the turbine is overhauled or the casing dismantled.

As regards the construction of the power station building, especially the foundation, in addition to the arrangement of the supply ducts above the axial horizontal plane of the inner shell there is the advantage of a simpler layout in that previously the ducts were partly let into the foundation. The ducts and channels interfere with the structure of the foundation, reducing the rigidity of the foundation platform.

The invention will now be explained in more detail with reference to a drawing of an example, in which:

FIG. 1 shows a perspective view of the casing,

FIG. 2 is an outside view in direction A as indicated in FIG. 1,

FIG. 4 shows a cross-section along the plane B-B according to FIG. 1,

FIG. 5 is a cross-section of detail C according to FIG. 4.

Corresponding parts in the various figures are denoted by the same reference numbers.

Figure 3:
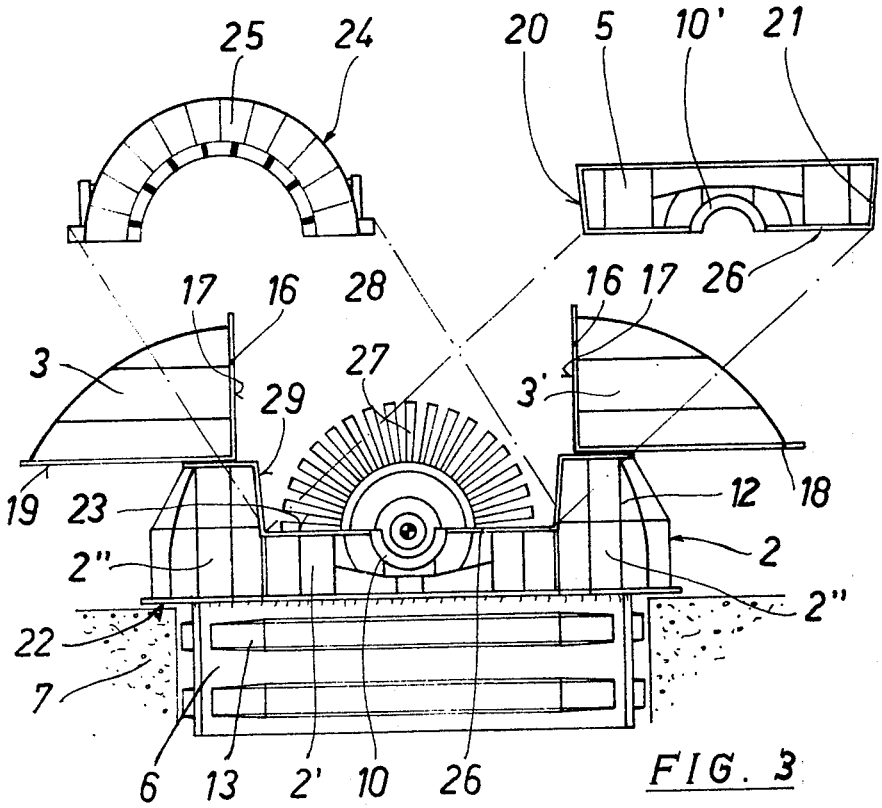
FIG. 3 is a view in the assembly condition corresponding to FIG. 2.

The example in FIG. 1 shows a casing of the low-pressure section of a steam turbine. The casing is of multiple-shell construction and made entirely of welded plates, the outer shell 1 comprising the supporting frame 2, the two halves of the exhaust cover 3,3', a yoke beam 5 at each end of the frame and the exhaust duct 6. The outer shell 1 incorporates in the supporting frame 2 the inner-shell carrier 8, by way of which the two part inner shell 24 and the outer shell 1 are rigidly joined to the foundation 7. The other peripheral parts 2' and 2'' of the supporting frame 2 rest on plates 11 which slide on each other in the horizontal plane, so that free expansion is possible. The upper half 10' of the shaft pass-through part is located in the removable yoke beam 5, and the lower half 10 in the fixed end part 2' of the supporting frame 2. The supporting frame 2 incorporates a system of stiffening ribs 12.

The exhaust duct 6 to the condenser below (not shown) is preferably welded to the supporting frame 2. The individual plates of the exhaust duct 6 are stiffened by means of profiled sections 13 and to accommodate the overhang 9 of the foundation 7 a recess 14 is provided which at the same time has the effect of stiffening the plates.

On the long sides of the supporting frame 2 there are penetrations 15 for the incoming ducts 4 carrying the working medium.

The two halves 3,3' of the exhaust cover are joined in the central vertical plane 17 by means of flange connection 16, and are fixed to the supporting frame 2 and yoke beam 5 at the horizontal flange 18.

FIG. 2 shows more clearly the arrangement of the dividing planes 17, 19, 22, 23 and 29, or their flanges 16, 18, 21 and 26, between the main components 2, 3, 5 and 6 of the outer shell 1. The dividing plane 22 of the outer shell 1 for the exhaust duct 6 is required on initial assembly, and is then permanently welded to the supporting frame 2. The dividing plane 29 at the ends 20 of each yoke beam 5 i.e. at its dividing flange 21 is inclined slightly to the vertical, so that the beam can be centered exactly in the supporting frame 2 on assembly. At the same time, therefore, the halves of the shaft penetration 10,10', split by the dividing plane 23, the flange 26 and its associated gland (not shown) are also positioned centrally.

In FIG. 3 the main parts 3,3' and 5 described above are shown separated from each other to illustrate better the ease of manipulating the casing. The two halves 3,3' of the exhaust cover are here slid apart laterally in the manner of a sliding roof, and by means of a simple support are carried by the long sides 2'' of the supporting frame 2. The inner shell 24 enclosing the rotor is then simply opened and its upper part 25 is lifted through the opening. Having removed the yoke beams 5 at each end from the supporting frame 2 and opened the bearings (not shown), the rotor 27 can also be taken out through the opening formed by the halves 3,3' of the exhaust cover. A cross-section through the casing is shown in FIG. 4. The inner shell 24 rests on the inner-shell carrier 8, which is firmly fixed to the foundation 7 and the overhang 9. The inner shell 24 is split in the axial horizontal plane 28 into its upper and lower hemi-cylindrical parts, which coincides with the axial (i.e. the rotor axis) dividing plane 23 between the yoke beam 5 and the supporting frame 2 in the region of the shaft penetration 10. The other horizontal dividing planes 19 and 22 between supporting frame 2 and exhaust cover 3,3' and exhaust duct 6, respectively, are clearly above or below this axial horizontal plane 28 of the inner shell 24.

The supply ducts 4 pass through thermally variable penetration structure 15 in the supporting frame 2 to the inner shell 24, to which they are joined. When the machine is dismantled or overhauled, it is then necessary only to disconnect this joint with the inner shell 24 and open the flange in the axial horizontal plane 28 of the inner shell 24 in order to lift off the upper part 25 of the shell. The supply ducts 4 for the working medium can remain, without impeding maintenance work.

FIG. 5 shows the detail C of FIG. 4 on a larger scale. A part of the surrounding flange 18 is provided on both the supporting frame 2 and the exhaust cover 3,3'. Prior to welding, the sealing surfaces 30 of this flange are machined. The flange is held together with the clamping strip 32 and bolts 33, which fit in tappings 34 in the surrounding flange 18 of the supporting frame 2. Irregularities, due, for example, in deformation caused during welding, can easily be compensated by using a soft rubber sectional seal 31, without impairing the tightness of the flanged joint, with respect to steam for example.

The casing of the invention can also be used for fluid-flow machines other than the steam turbine shown in the example, in which case it is necessary only to adapt the seals and flange joints to suit the prevailing pressure and temperature. The parts 3 of the exhaust cover, instead of being lifted with a crane, can also be moved on rollers or the like in a guide slot in the supporting frame, in which case the sealing arrangement at dividing planes 17 and 19 of the surrounding flange 18 and vertical flange 16 are somewhat modified.

For the purpose of easier fabrication, the supporting frame 2 can be further divided, but there is then no need for removable means of connection between the individual parts because for overhauls it is not necessary for the outer shell 1 to open beyond the travel of the exhaust cover 3.

The new form of the outer shell 1 also allows savings in the height of the power station building, because the required height of the crane hook can be greatly reduced. This is achieved on the one hand by the fact that the supply ducts 15 are let into the supporting frame 2, and on the other, because of the low height of lift when the rotor 27 is taken out of the supporting frame 2.

I claim:

1. In a fluid flow machine of the turbine type such as a steam turbine, the combination comprising an inner shell surrounding the rotor component of the machine, said inner shell being divided along a horizontal plane passing through the rotor axis into upper and lower separable hemi-cylindrical parts and secured to a foundation, an outer shell surrounding said inner shell, said outer shell being comprised of a closed support frame secured to said foundation, an exhaust duct depending from said frame, each end of said support frame including a lower fixed part incorporating the lower half of the pass-through structure for the rotor shaft, and a removable upper part in the form of a yoke beam incorporating the upper half of the shaft pass-through structure, and an exhaust cover above said support frame, said exhaust cover being divided into two longitudinally extending separable halves joined to each other and to the adjacent surfaces of said support frame by means of fluid-tight connecting means.

2. A fluid flow machine of the turbine type as defined in claim 1 wherein said support frame includes a pass-through for admission of the fluid working medium located above the horizontal dividing plane of said inner shell.

3. A fluid flow machine of the turbine type as defined in claim 1 wherein the said separable halves of said exhaust cover are slidable laterally apart on the upper surface of said support frame to a position permitting removal of the rotor in the upward direction following removal of said yoke beams.

4. A fluid flow machine of the turbine type as defined in claim 1 wherein the halves of said exhaust cover are provided with guide slots and rollers engaged with the upper surface of said support frame to a position permitting a sliding movement of said exhaust cover halves and removal of the rotor in the upward direction through the exposed area following removal of said yoke beams.

5. A fluid flow machine of the turbine type as defined in claim 1 wherein said yoke beams are rendered self-centering in the lower fixed end parts of said support frame by inclusion of interfitting surfaces inclined to the vertical.

6. A fluid flow machine of the turbine type as defined in claim 1 wherein said fluid-tight connection means joining the separable halves of said exhaust cover to each other and to the adjacent surfaces of said support frame are constituted by connection flanges including sealing strips therebetween.

* * * * *